US009867420B2

(12) United States Patent
Steinberg

(10) Patent No.: US 9,867,420 B2
(45) Date of Patent: Jan. 16, 2018

(54) FLIP FLOPS WITH WIND AND WATER BARRIER

(71) Applicant: Dan Steinberg, Blacksburg, VA (US)

(72) Inventor: Dan Steinberg, Blacksburg, VA (US)

( * ) Notice: Subject to any disclaimer, the term of this patent is extended or adjusted under 35 U.S.C. 154(b) by 0 days.

(21) Appl. No.: 15/652,218

(22) Filed: Jul. 17, 2017

(65) Prior Publication Data

US 2017/0311675 A1 Nov. 2, 2017

Related U.S. Application Data

(63) Continuation-in-part of application No. 14/979,469, filed on Dec. 27, 2015.

(51) Int. Cl.

| | |
|---|---|
| ***A43B 3/12*** | (2006.01) |
| ***A43B 7/12*** | (2006.01) |
| ***A43B 13/04*** | (2006.01) |
| ***A43B 13/12*** | (2006.01) |
| ***A43B 13/14*** | (2006.01) |

(52) U.S. Cl.

CPC ..... *A43B 3/128* (2013.01); *A43B 3/12* (2013.01); *A43B 3/122* (2013.01); *A43B 7/12* (2013.01); *A43B 13/04* (2013.01); *A43B 13/12* (2013.01); *A43B 13/141* (2013.01)

(58) Field of Classification Search

CPC ..... A43B 3/10; A43B 3/12; A43B 3/128
USPC ..... 36/8.1, 11.5
See application file for complete search history.

(56) References Cited

U.S. PATENT DOCUMENTS

| | | | | | |
|---|---|---|---|---|---|
| 1,088,309 | A * | 2/1914 | Wiedt | A43B 3/126 | 36/11.5 |
| 2,327,322 | A * | 8/1943 | Slater | A43B 3/10 | 36/11.5 |
| 2,491,297 | A * | 12/1949 | Brown | A43B 3/122 | 36/101 |
| 3,605,292 | A * | 9/1971 | Goldblatt | A43B 3/12 | 36/8.1 |
| 5,852,885 | A * | 12/1998 | Ferniani | A43B 3/103 | 36/101 |
| 5,946,823 | A * | 9/1999 | Yates | A43B 3/10 | 36/101 |
| 6,237,249 | B1 * | 5/2001 | Aguerre | A43B 3/103 | 36/11.5 |
| 6,418,642 | B1 * | 7/2002 | Bigg | A43B 3/102 | 12/142 S |
| 6,493,965 | B1 * | 12/2002 | Bathum | A43B 3/126 | 36/11.5 |
| 6,990,753 | B2 * | 1/2006 | Fuerst | A43B 3/108 | 36/11.5 |
| 7,222,442 | B2 * | 5/2007 | Hillyer | A43B 3/103 | 36/10 |

(Continued)

*Primary Examiner* — Marie Bays

(57) ABSTRACT

Flip flop sandals with a barrier around a perimeter of a sole. The barrier forms a continuous loop, thereby protecting the feet from wind and water in all directions. The flip flops comprise a medial strap, a lateral strap and a toe strap attached to the sole at locations interior to the barrier. The barrier protects the feet from water splashes, puddles, wet grass and wind. The barrier height can be in the range of 0.5-4 inches or 0.7-3 inches. Alternatively, the barrier height can be at least 40% or ½ a length of the toe strap. The barrier can be made of closed cell foam or plastic film. The attachment between the sole and barrier can be water tight.

20 Claims, 11 Drawing Sheets

(56) References Cited

U.S. PATENT DOCUMENTS

| | | | | |
|---|---|---|---|---|
| 7,234,251 | B2 * | 6/2007 | Fuerst | A43B 1/0027 36/11.5 |
| 7,439,837 | B2 * | 10/2008 | McDonald | A43B 3/126 36/11.5 |
| 2005/0274040 | A1 * | 12/2005 | Fuerst | A43B 3/108 36/11.5 |
| 2006/0090374 | A1 * | 5/2006 | Hillyer | A43B 3/103 36/100 |
| 2007/0068038 | A1 * | 3/2007 | McClellan | A43B 3/105 36/11.5 |
| 2007/0130802 | A1 * | 6/2007 | Condie | A43B 1/0054 36/101 |

* cited by examiner

FLIP FLOPS WITH WIND AND WATER BARRIER

RELATED APPLICATIONS

The present application is a continuation-in-part of copending patent application Ser. No. 14/979,469 filed on Dec. 27, 2015.

FIELD OF THE INVENTION

The present invention relates generally to sandals and in particular to thong/flip flop sandals that protect the feet from water splashes, puddles, wet grass, and wind.

BACKGROUND OF THE INVENTION

Flip flop or thong sandals are popular for their breathability and comfort. However, the openness causes some problems. Conventional flip flops do not protect the feet from water splashes, puddles or wet grass. Also, flip flops provide no protection from wind, which can be undesirable in cool weather.

A number of patents teach sandals with toe guards. For example, U.S. Pat. Nos. 6,493,965, 6,990,753, and 7,234,251 teach toe guards that protect the toes from rocks and injury. These sandals provide very limited protection from water splashes, wet grass or wind. Also, they provide essentially zero protection from water in case a user steps into a water puddle.

U.S. Pat. No. 2,491,297 teaches footwear with a thong. It can provide protection from water, but lacks the breathability and comfort of a sandal or flip flop.

U.S. Pat. No. 2,327,322 teaches a shoe construction with a "vamp frame" that "grips the foot of the wearer firmly". Since the vamp frame grips the foot, the shoe does not provide the breathability and comfort of flip flops.

U.S. Pat. No. 5,893,221 teaches a sandal having a heel cup that stabilizes the ankle by reducing inversion and eversion of the heel. The heel cup impairs the breathability desired of flip flop sandals. The heel cup edges do not provide useful protection from wind and water.

U.S. Pat. No. D453,611 shows a design for a flip flop sandal with a short ridge surrounding the flip flop. The ridge does not provide substantive protection from wind and water. Also, in the heel area, the ridge comprises a heel cup that reduces breathability. The heel cup conforms to the shape of the heel, which is undesirable for breathability and comfort.

The combination of high breathability and water protection is desirable for footwear. Both are long-felt needs. However, these needs are generally in conflict and force undesirable design tradeoffs.

There is a need for comfortable flip flop sandals that provide breathability in combination with wind and water protection.

SUMMARY

Provided is a flip flop sandal having a sole, a medial foot strap and a lateral foot strap. The medial foot strap extends over the medial side of the foot, and the lateral foot strap extends over the lateral side of the foot. The straps are connected to the sole, and to a connection point. A toe strap is connected between the connection point and the sole. A barrier is attached to the sole around a perimeter of the sole. The barrier forms a continuous loop. The barrier extends upwards from the sole and has a minimum height everywhere of at least 35%, 40% or ½ a length of the toe strap.

Accordingly, the barrier provides wind and water protection for the foot.

The barrier can have a height of about 0.5 to 4 times the toe strap length. The barrier can have an average height, or a height everywhere in the range of 0.7-4 inches, or 1-4 inches.

The barrier height in a front portion of the flip flop can be greater than the barrier height in a rear portion of the flop flop.

The medial and lateral foot straps can be attached to an inner surface of the barrier. This can help to hold up the barrier, so that it does not fall over.

The barrier and sole can comprise a single integral part.

The present flip flop can comprise a removably attachable cover. The cover can be removably attachable to one or more of the foot straps, or removably attachable to the connection point. Hook and loop fastener can be used for attaching the cover.

DETAILED DESCRIPTION

The present invention provides flip flop sandals having a barrier disposed around a perimeter of the sandal. The barrier is a continuous loop. The barrier is tall enough to provide useful protection from water splashes, puddles, wet grass and wind. For example, the barrier can be about 0.5-4 inches tall (measured from a top surface of a sandal sole). The barrier is preferably impermeable to water and wind. For example, the barrier can be made of closed-cell foam or rubber or plastic film.

The present invention provides a desirable combination of high breathability and water protection. Breathability is provided because the flip flops are open in the vertical direction. Water protection is provided because the barrier forms a continuous loop around the sole, and is tall enough to block splashes, wet grass, and puddles.

Figure 1:
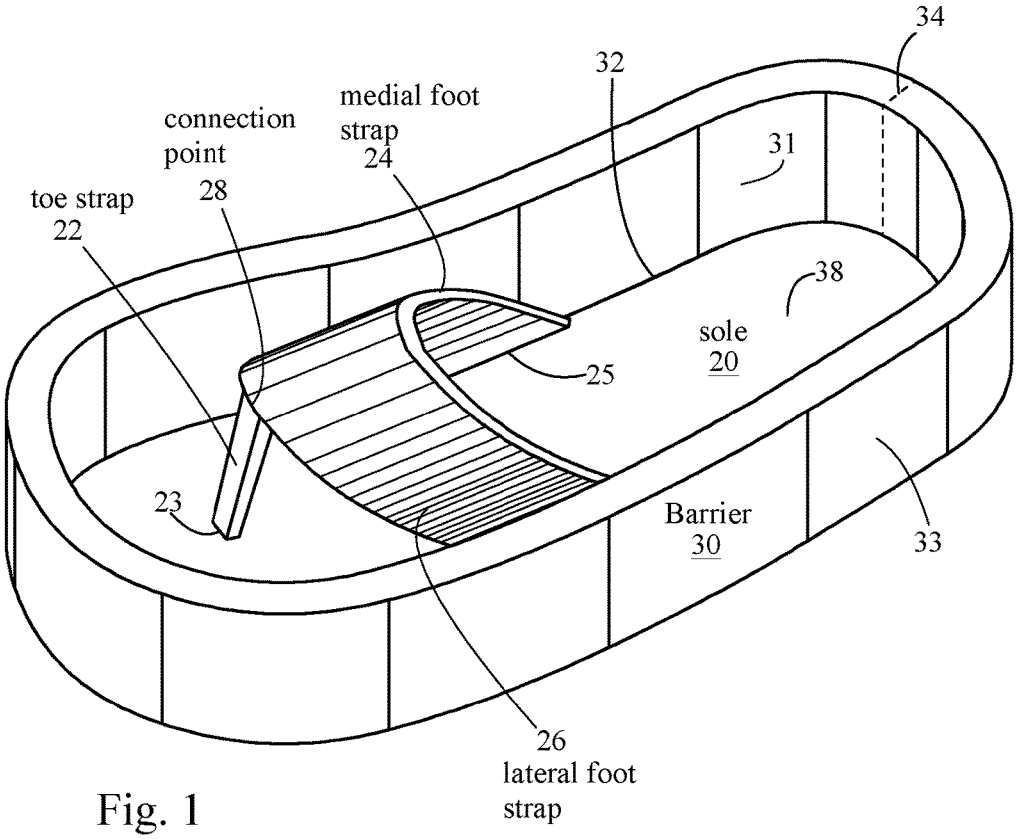
FIG. 1 shows a perspective view of a flip flop according to the present invention.

FIG. 1 shows a perspective view of a flip flop sandal according to the present invention. The flip flop has a sole 20. A toe strap 22, a medial foot strap 24, and a lateral foot strap 26 are attached to the sole 20, as known in the art. The medial strap 24, lateral strap 26, and toe strap 22 are attached at a connection point 28. The medial strap 24 covers the medial side of the foot, and the lateral strap 26 covers the lateral side of the foot, as known in the art.

The medial and lateral straps 24 26 can comprise a single piece of material. The toe strap 22 is located such that it extends between the big toe and the second toe of a wearers foot (not shown), as known in the art.

A barrier 30 is attached to the sole along the entire perimeter of the sole 20. The barrier 30 forms a continuous closed loop. The barrier 30 can be attached to the sole 20 at a top surface 38 of the sole 20 or at a side edge of the sole 20. The barrier 30 and sole 20 are attached at a seam 32, which may have a waterproof construction. For example, the barrier 30 and sole 20 may be attached at the seam 32 by rubber cement, contact cement, urethane adhesive, or cyanoacrylate adhesive, as known in the art. The seam 32 can be waterproof.

The barrier 30 has an interior surface 31 and an exterior surface 33.

The barrier 30 may comprise a vertical seam 34 in embodiments where the barrier is made from a strip of material wrapped around the sole 20. The vertical seam 34 will not be present in some embodiments of the invention. For example, if the sole 20 and barrier 30 comprise a single integral part (e.g. made by molding), then the vertical seam 34 and seam 32 may not be present.

The flip flop sandal can be made of many materials known in the art. For example, the sole 20 can be made of ethylene vinyl acetate (EVA) foam, polyurethane foams, rubber or foam rubbers. The straps 22 24 26 can be made of nylon or polyester fabric or webbing, leather, plastic or rubber. The use of such materials in sandals and flip flops is known in the art.

The straps 22 24 26 can be attached to the sole 20 with adhesive such as contact cement, urethane adhesive, or rubber cement. The sole 20 can have a layered structure and the straps 22 24 26 can extend between the layers comprising the sole 20. Such structures and construction methods are known in the art of sandal and flip flop fabrication.

The barrier 30 is made of semi-rigid, flexible material able to hold itself vertically without falling over. Also, the barrier 30 is able to flex as a wearer walks. The barrier 30 can be made of many materials known in the art: EVA foam, polyurethane foams, solid rubber or foam rubber, polyvinyl chloride (PVC) film or foam, fabrics, polymer-impregnated fabrics, polyester or polyethylene foams or film. The barrier 30 can also be made of solid film or sheet, such as PVC or rubber film or sheet, or leather. The barrier 30 can be opaque or transparent. Preferably, the barrier 30 is made of water-impermeable material, such as closed cell foam or solid polymeric sheet. The present invention is not limited to any particular material for the barrier 30.

In some embodiments, polymeric closed-cell foams may be preferred for the barrier 30 because they are lightweight, flexible, waterproof and resist falling over.

The barrier 30 may comprise a laminated material, with the laminated layers oriented vertically (not shown). The laminated layers can comprise any combination of the materials listed above. For example, the barrier 30 may comprise a layer of EVA foam and a layer of decorative fabric. The decorative fabric (not shown) can cover the interior and/or exterior surfaces 31 33 of the barrier 30. The fabric may protect the foam from abrasion and damage.

Figure 2:
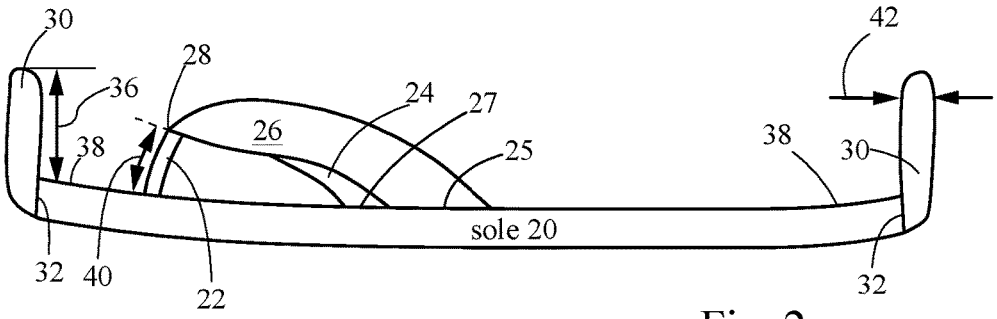
FIG. 2 shows a cross sectional side view of a flip flop according to the present invention.

FIG. 2 shows a side view of the flip flop according to the present invention. The barrier 30 has a height 36 measured from a top surface 38 of the sole 20. The height 36 can be about 0.5-4 inches or 0.7-3 inches for example.

Figure 3:
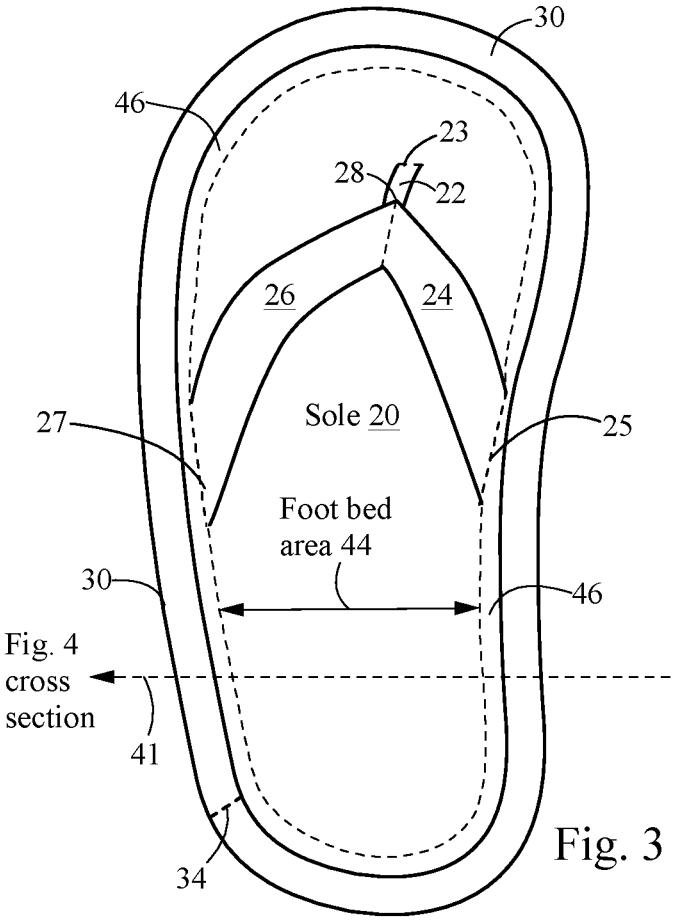
FIG. 3 shows a top view of a flip flop according to the present invention.
Figure 4:
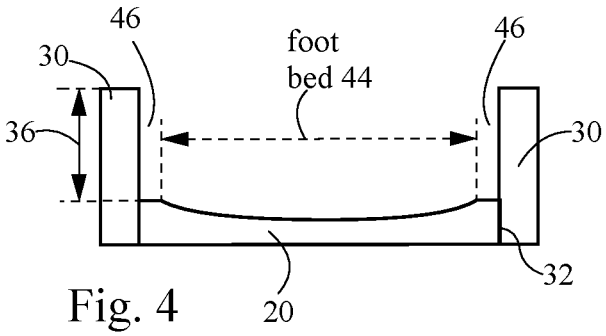
FIG. 4 shows a cross sectional view of a flip flop according to the present invention.

FIG. 3 shows a top view of an embodiment of the present invention. FIG. 4 shows a cross sectional view cut across line 41. The barrier 30 comprises a continuous closed loop extending around the perimeter of the sole 20. Since the barrier 30 is a continuous loop, wind and water protection is provided in all directions.

The toe strap 22, medial strap 24, and lateral strap 26 are attached to the sole 20 at attachment locations 23 25 27 interior to the barrier 30. In other words, the attachment locations 23 25 27 are inside the continuous closed loop defined by the barrier 30. The medial and lateral strap attachment locations 25 27 can be flush with the interior surface 31 of the barrier 30.

The barrier 30 can have height within a range at all locations along the length of the barrier 30 (i.e. "everywhere"). The barrier height can be in the range of 0.7-3 or 1-3 inches everywhere for example. Alternatively, the barrier 30 can have an average height, averaged over the entire length of the barrier 30. The average height can be at least 0.7, 1 or 1.2 inches for example, or in the range of 0.7-4 or 1-4 inches.

The toe strap 22 has a length 40. The toe strap length 40 is measured between the sole top surface 38 and the connection point 28. It is noted that the toe strap length 40 refers to the length of the toe strap 22 when straightened. If the toe strap 22 has a built-in curvature, it should be straightened when measuring the toe strap length 40.

If the sole 20 has a raised area where the toe strap 22 is attached to the sole 20 (not shown here, but a raised area at the toe strap-sole attachment is present in D453,611 to Birkenstock), then the toe strap length is defined as including the height of the raised area. In other words, the toe strap length for the purposes of the present claims will be the measured toe strap length plus the height of the raised area.

Typically, flip flop sandals for adults have a toe strap length 40 of about 1-2 inches. In some embodiments of the invention, the barrier eight 36 is at least 35%, 40%, ½, ⅔, or ¾ of the toe strap length everywhere along the barrier 30. The barrier height 36 can be in the range of about 0.5-4 or 0.7-4 or 1-4 times the toe strap length 40.

Alternatively, the barrier height 36 can be at least 0.5-0.7 inches or at least 35% of the toe strap length 40, whichever is greater. This alternative requirement will tend to accommodate variations in flip flop sizes and toe strap lengths while assuring adequate barrier height even for small size flip flop sandals.

The barrier 30 has a thickness 42. The thickness 42 can be about 0.04-0.75 inches or 0.125-0.5 inches for example. The optimal barrier thickness will depend on the weight, rigidity and density of the barrier material. Low density barrier materials can have greater barrier thickness.

One specific embodiment has a barrier 30 made of EVA closed-cell foam with density 2-4 pounds/cubic foot, a thickness 42 of 0.25 inches and a height 36 of about 1-3 inches.

The barrier 30 can be made of solid plastic film or sheet, such as PVC or rubber sheet. In such embodiments, the barrier can be thinner than 0.1 inches. The barrier 30 should be thick enough and rigid enough such that it can stand vertically without falling over.

The present flip flop sandals are worn and used like conventional flip flops. The wearers foot is disposed between the sole 20 and the straps 22 24 26. The toe strap 22 is disposed between the big toe and the second toe, as known in the art. While walking, the flip flop moves vertically (i.e. "flip flop action") relative to the foot, like conventional flip flops. The barrier 30 does not interfere with the flip flop action movement of the flip flop.

The barrier 30 does not hold the flip flop on the foot and does not grip or compress the foot. In other words, the barrier 30 does not compress two opposite sides of the foot simultaneously. Consequently, the barrier 30 does not interfere with vertical movement required for flip flop action. Also consequently, the present flip flop is quickly and easily put on the foot, and easily removed. The flip flop can be put on and taken off without using the hands, and can be just as easy to take on and off as a conventional flip flop sandal.

In the embodiment of FIG. 3 and FIG. 4, the sole 20 comprises a foot bed area 44 and a gap area 46 disposed around the foot bed area 44. The foot bed area is where a wearers foot contacts and rests upon the sole 20. Consequently, the gap area 46 indicates a gap between the wearers foot (not shown) and the barrier 30. The gap area 46 is optional in the present invention and appended claims.

Figure 5:
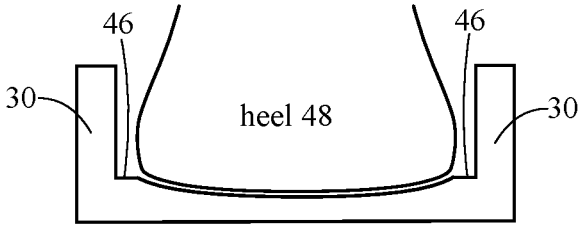
FIG. 5 shows a cross sectional view of a flip flop with a foot.

FIG. 5 shows a cross sectional view cut across line 41 and including a foot heel 48.

Figure 6:
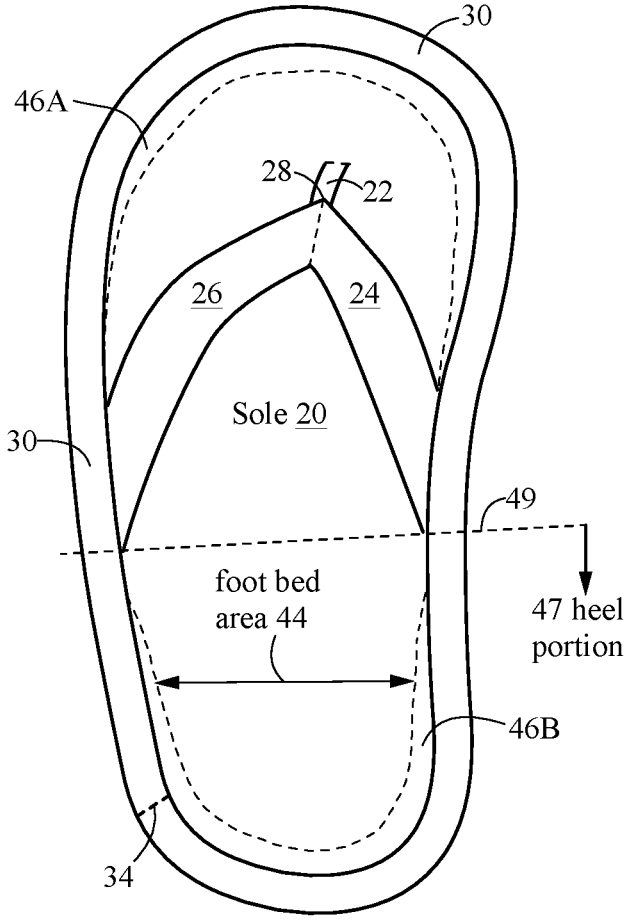
FIG. 6 shows a top view of a flip flop with gap areas present in only some portions of the perimeter.

FIG. 6 shows a top view of an embodiment having two separate gaps areas: a forward gap area 46A around the toes, and a rear gap area 46B in a heel portion 47. The heel portion 47 is defined by a line 49 drawn between rearmost corners of the medial and lateral straps 24 26.

Figure 7:
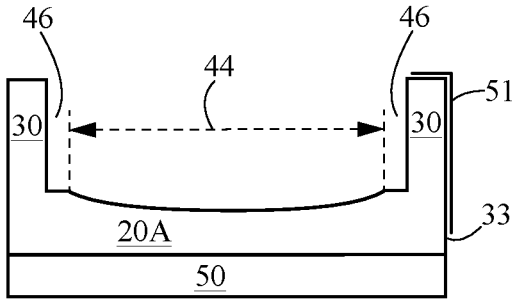
FIG. 7 shows a cross sectional view of a flip flop in which the barrier and the sole are monolithic.

FIG. 7 shows a cross sectional view of an alternative embodiment in which the sole comprises an upper sole 20A and a lower sole 50. The upper sole 20A is monolithic with the barrier 30. The seam 32 (illustrated in FIG. 2) is not present. The barrier 30 and upper sole 20A can be made as a single integral part by molding. An advantage of this design is that adhesive glue for seam 32 is not necessary, and assembly of the barrier 30 and sole 20 is obviated.

The lower sole 50 that can be harder and more abrasion-resistant than the upper sole 20A.

Also shown in FIG. 7 is an exterior fabric covering 51 attached to the exterior surface 33 of the barrier 30. The exterior fabric covering 51 can have decorative prints or patterns.

Figure 8:
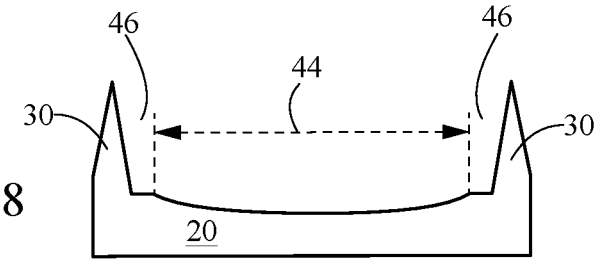
FIG. 8 shows a cross sectional view of a flip flop in which the barrier has a tapered thickness.

FIG. 8 shows a cross sectional view of an embodiment in which the barrier 30 has a tapered thickness. The barrier 30 is wedge-shaped, and is thinnest at a top edge.

Figure 9A:
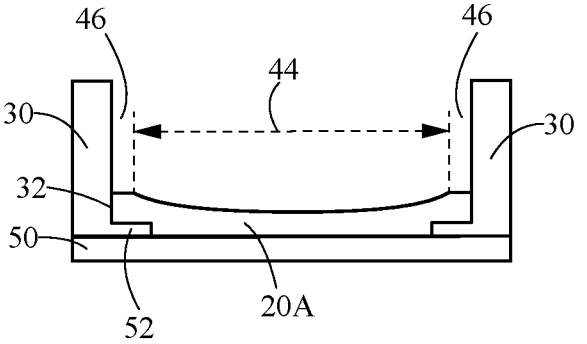
FIG. 9A shows a cross sectional view of a flip flop in which the barrier has tabs disposed between an upper sole and a lower sole.
Figure 9B:
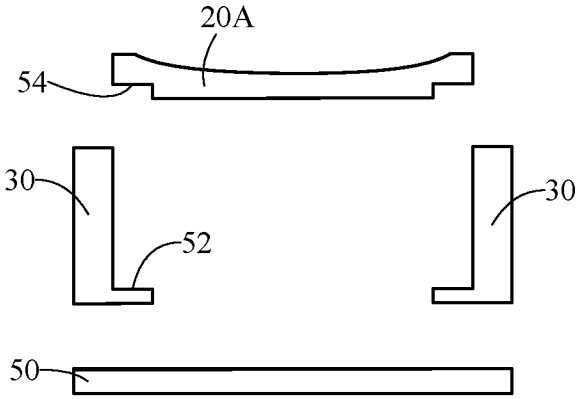
FIG. 9B shows a cross sectional exploded view of the embodiment of FIG. 9A.

FIGS. 9A and 9B show assembled and exploded cross sectional views of an embodiment in which the barrier 30 has attachment tabs 52 disposed between the upper sole 20A and the lower sole 50. The attachment tabs 52 provide a secure attachment between the barrier 30 and the upper and lower soles 20A 50.

The upper sole 20A is shown with an optional notch 54. The notch 54 accommodates the attachment tab 52. The notch 54 may alternatively be present in the lower sole 50. The notch 54 is optional in the present invention.

The attachment tab 52 may create undesirable bumps in the foot bed area 44, or voids between the upper sole 20A and lower sole 50, particularly if the notch 54 is not present. There are several ways to avoid this potential problem. For example, the attachment tabs 52 can be made thin enough to not create bumps, or the attachment tabs 52 can be made of soft or compressible material.

Figure 10:
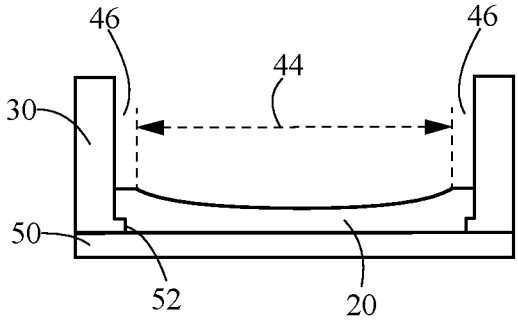
FIG. 10 shows a cross sectional view of a flip flop in which the barrier has short tabs disposed between an upper sole and a lower sole.

Alternatively, as shown in FIG. 10 the attachment tabs 52 are short so they are present only under the gap area 46.

Figure 11:
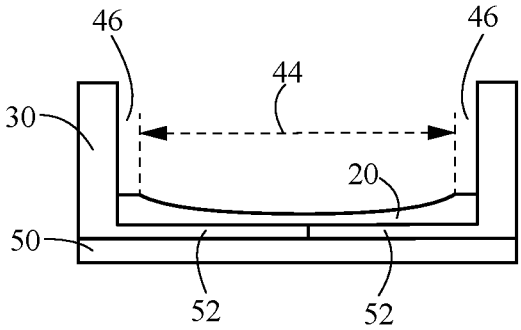
FIG. 11 shows a cross sectional view of a flip flop in which the barrier has long tabs disposed between an upper sole and a lower sole.

Alternatively, as shown in FIG. 11 the attachment tabs 52 are long and wide so that they cover nearly all the foot bed 44.

These design options can prevent the attachment tabs 52 from creating undesirable bumps in the surface of the sole or in the foot bed area 44.

Figure 12A:
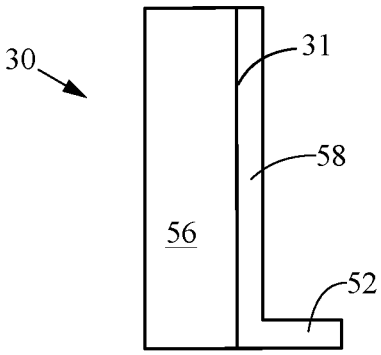
FIGS. 12A and 12B show cross sectional views of barriers having laminated tab layers.
Figure 12B:
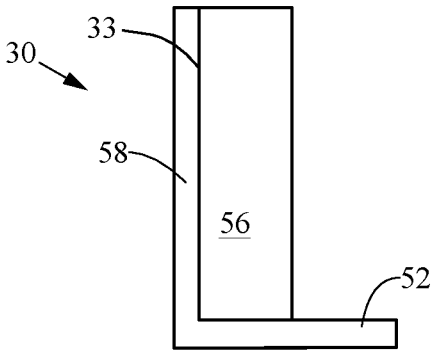

FIGS. 12A and 12B show cross sectional views of barriers 30 according to alternative embodiments of the present invention. The barriers 30 comprise a wall portion 56 and a attachment tab layer 58. The wall portion 56 and attachment tab layer 58 can be attached by adhesive, such as contact cement. The attachment tab 52 is an extension of the attachment tab layer 58.

The wall portion 56 can be made of closed cell foam and the attachment tab layer 58 can be made of woven or knitted fabric or polymeric film for example. The fabric can be impregnated with polymeric material, such as polyurethane, PVC, silicone, or rubber for example. An advantage of using fabric for the attachment tabs 52 is that it can be thin, thereby avoiding bumps in the sole top surface 38.

In the embodiment of FIG. 12A the attachment tab layer 58 is disposed on the barrier interior surface 31. In the embodiment of FIG. 12B the attachment tab layer 58 is disposed on the barrier exterior surface 33. Accordingly, if a decorative exterior surface is desired, the attachment tab layer 58 of FIG. 12B can comprise a decorative fabric.

Figure 13:
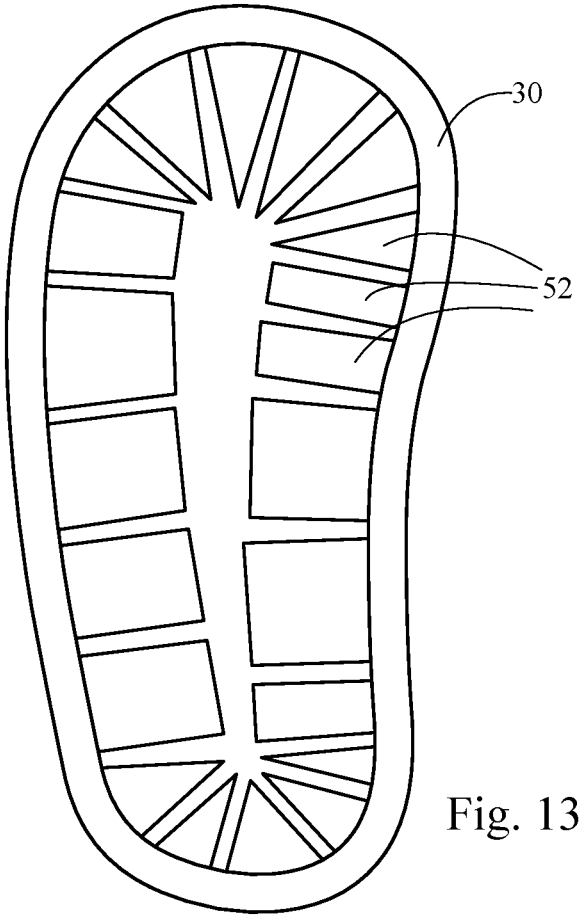
FIG. 13 shows a top view of a barrier and attachment tabs according to a specific embodiment of the invention.

FIG. 13 shows a top view of the barrier 30 with a specific design for the attachment tabs 52. The tabs 52 are folded into the plane of the drawing. For clarity, the straps 22 24 26 and sole 20 are not shown.

Figure 14:
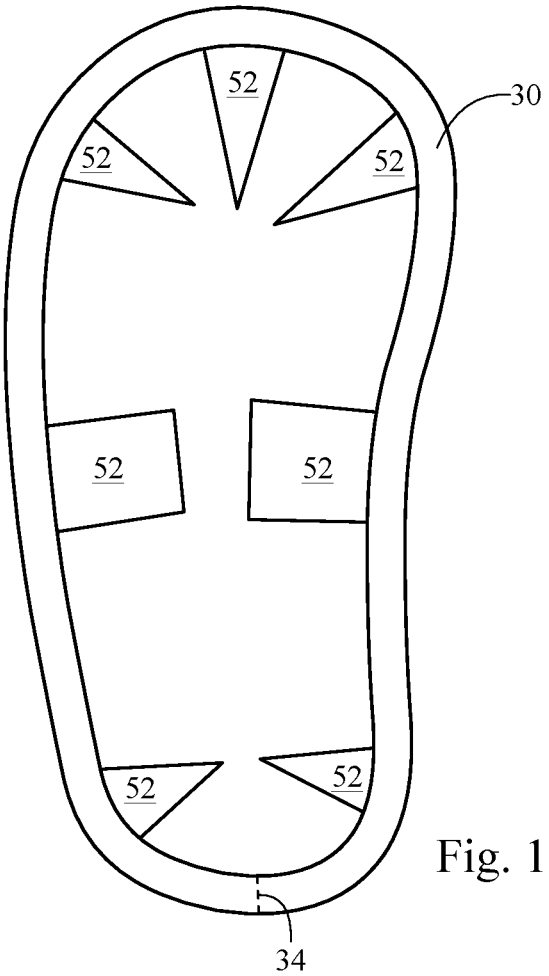
FIG. 14. shows a top view of a barrier and attachment tabs according to a specific embodiment of the invention.
Figure 15:
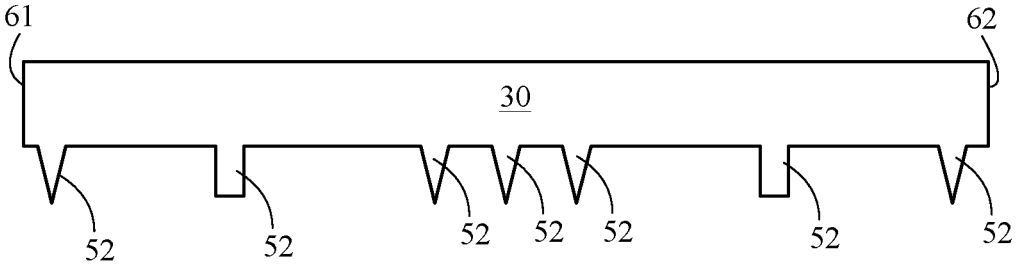
FIG. 15 shows a die cut shape to make the barrier and attachment tabs in the embodiment of FIG. 14.

FIG. 14 shows a top view of another specific design for the barrier 30 and attachment tabs 52. For clarity, the straps 22 24 26 and sole 20 are not shown. FIG. 15 shows the shape of the barrier 30 and attachment tabs 52 (of FIG. 14) laid down flat. Edges 61 62 join to form vertical seam 34 when assembled. The barrier 30 with tabs 52 of FIG. 15 can be made by die-cutting, as known in the art. After die-cutting, the attachment tabs 52 are folded 90 degrees.

Figure 16:
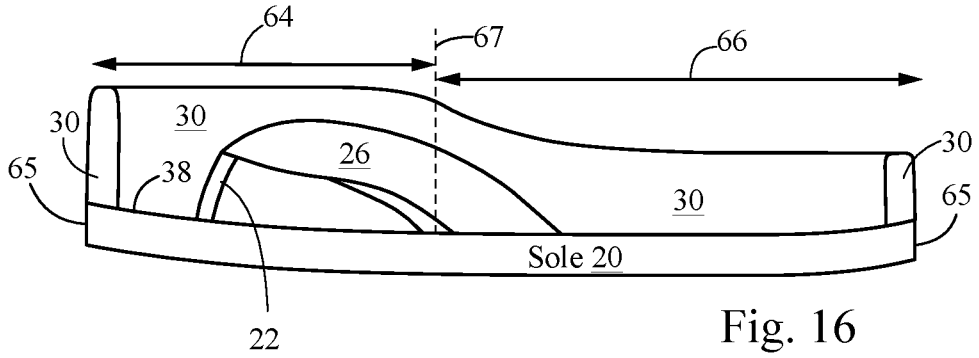
FIG. 16 shows a cross sectional side view of an embodiment in which the barrier is taller in a front portion of the flip flop.

FIG. 16 shows a cross sectional side view of an embodiment in which the barrier 30 is taller in a front portion 64, and shorter in a rear portion 66. Alternatively, the barrier 30 can be taller in the rear portion. The boundary 67 between the front portion 64 and rear portion 66 is approximately where the medial and lateral straps 24 26 attach to the sole 20. The boundary 67 between front and rear portions, as defined for the appended claims, can be located anywhere in a middle third of the flip flop. In other words, the front portion 64 can comprise the front ⅓ to ⅔ of the flip flop, and the rear portion 66 can comprise the rear ⅓ to ⅔ of the flip flop.

FIG. 16 also illustrates an embodiment in which the barrier 30 is attached to a top surface 38 of the sole 20, instead of a side edge 65 of the sole 20.

Figure 17A:
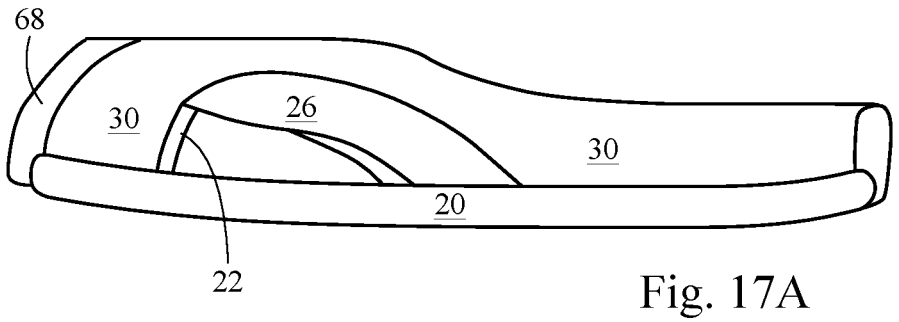
FIGS. 17A and 17B show embodiments in which the barrier is curved inwardly or outwardly.
Figure 17B:
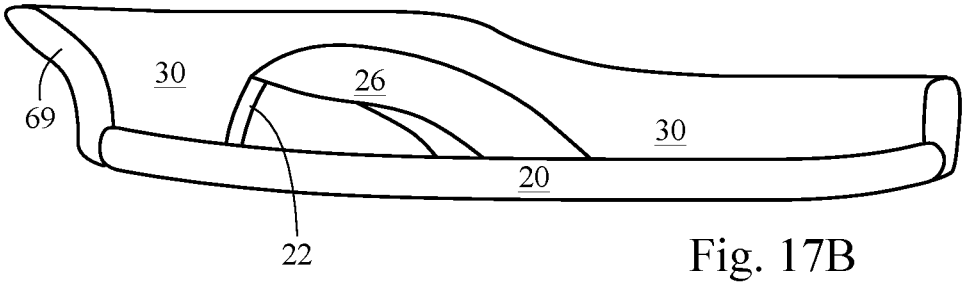

FIGS. 17A and 17B show alternative embodiments in which the barrier 30 is curved or angled with respect to the sole 20. In the embodiment of FIG. 17A the barrier 30 has an inward curvature 68. In the embodiment of FIG. 17B the barrier 30 has an outward curvature 69. In embodiments where the barrier 30 is curved, the barrier height is measured along the length of the curve (i.e. it should be straightened before measurement).

Figure 18A:
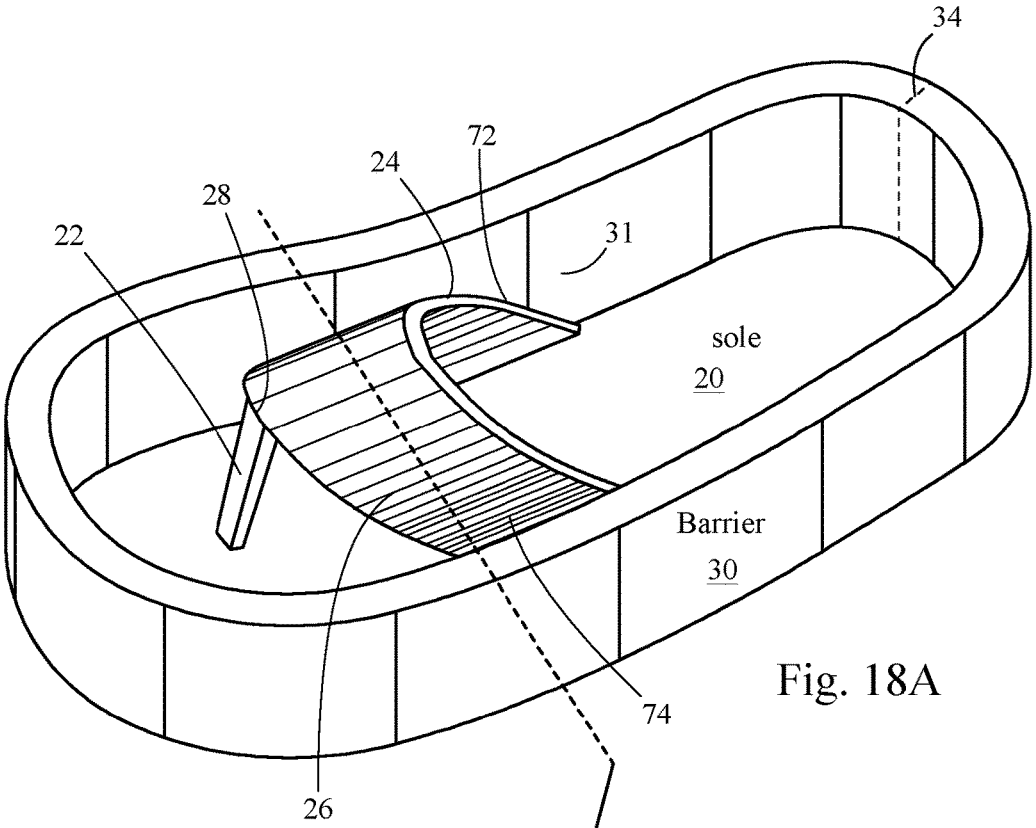
FIGS. 18A and 18B show perspective and cross sectional views of an embodiment in which the foot straps are attached to the barrier.
Figure 18B:
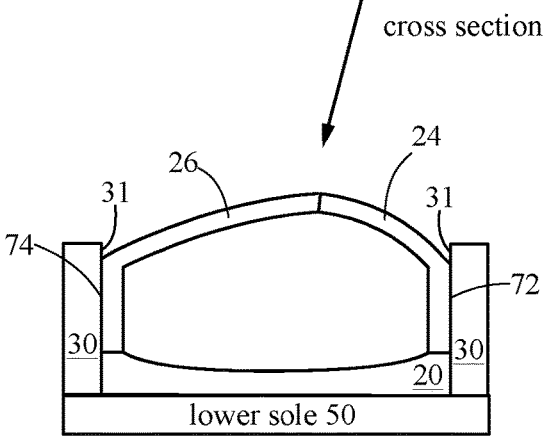

FIGS. 18A and 18B show perspective and cross-sectional views, respectively, of an alternative embodiment in which the medial foot strap 24 and/or lateral foot strap 26 are attached to the interior surface 31 of the barrier 30. Specifically, the outer surface 72 of medial strap 24 is attached to barrier interior surface 31. The outer surface 74 of lateral strap 26 is attached to the barrier interior surface 31.

An advantage of attaching the medial and lateral straps 24 26 to the barrier interior surface 31 is that it helps to hold the barrier 30 upright. If the barrier 30 is free-standing (i.e. is not attached to the straps 24 26), then it can sometimes fall over or deform after extended use.

Figure 19:
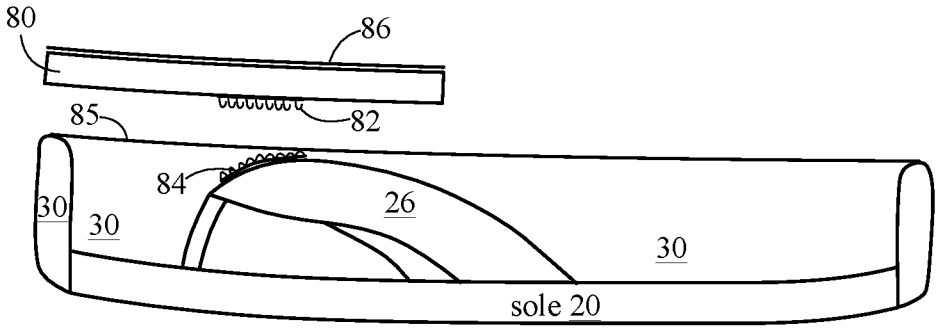
FIG. 19 shows a cross sectional side view of an embodiment having a cover.

FIG. 19 shows a cross sectional side view of an embodiment having a removable cover 80. The cover 80 has hook (or loop) fastener 82, and the straps 24 26 have loop (or hook) fastener 84. The cover 80 can be made of the same material as the barrier 30, such as closed cell foam (e.g. EVA foam). The cover 80 can be waterproof. The cover can have a decorative fabric covering 86.

The cover 80 may rest against a top edge 85 of the barrier 30 and thereby provide enhanced protection against wind, water splashes and rain. The cover 80 may be removably attachable to the top edge 85 (e.g. with hook/loop fastener), or may have no attachment to the top edge 85.

The hook/loop fastener 82 84 can be replaced with other types of removable attachments, such as buttons, laces, magnets or the like.

Figure 20:
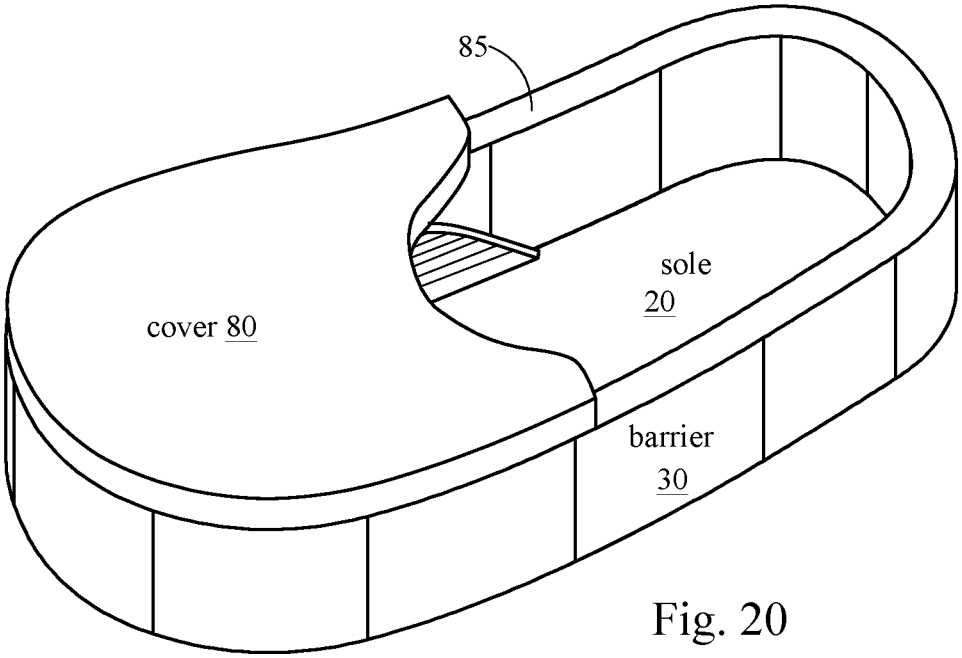
FIG. 20 shows a perspective view of an embodiment having a cover.

FIG. 20 shows a perspective view of the flip flop with the cover 80 in place.

The cover 80 provides increased thermal insulation, and water protection (e.g. rain protection). Optionally, the cover 80 can be wider than the flip flop so that it slightly overhangs the barrier 30.

Figure 21:
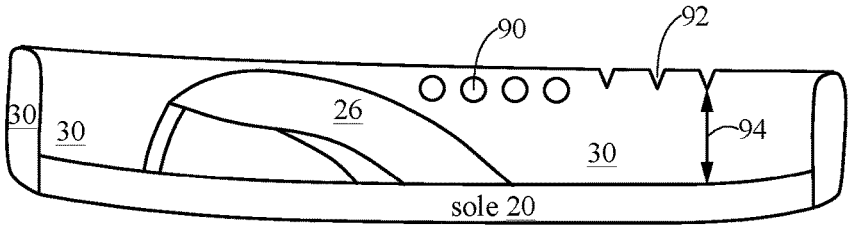
FIG. 21 shows a cross sectional side view of an embodiment having holes and notches in the barrier.

FIG. 21 shows an alternative embodiment in which holes 90 and notches 92 are present in the barrier 30. The holes 90 and notches 92 can be decorative or can provide increased breathability. The barrier 30 has a lower height 94 in the notch locations.

If the notches 92 are covered with a water resistant or waterproof material, then the notches 92 do not create a lowering of the barrier height as its defined in the present claims.

The holes 90 and notches 92 can be covered with breathable fabric or mesh and thereby provide increased breathability and lighter weight without significantly affecting water protection.

The holes 90 or notches 92 can be used for attaching or mounting decorative accessories. Decorative accessories can be inserted into the holes 90. Such accessories may seal the holes 90, and render them water resistant or water proof. Also, the holes 90 or notches 92 can comprise transparent windows made of clear polymeric film for example.

Figure 22:
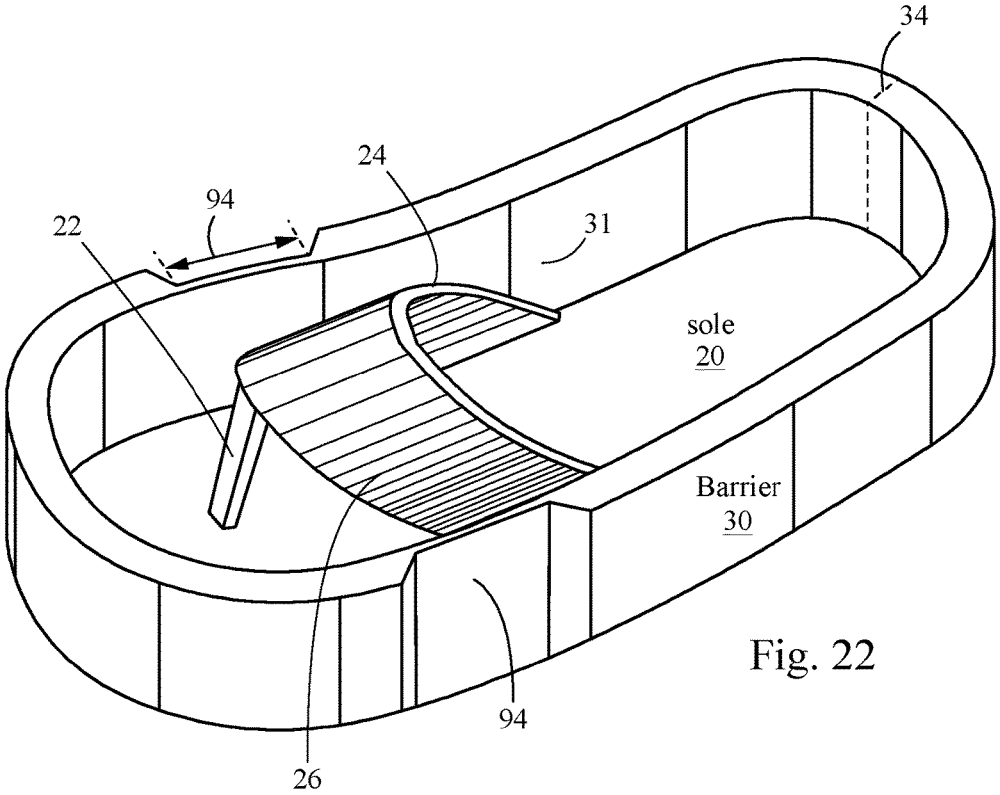
FIG. 22 shows a perspective view of an embodiment in which the barrier has sections with enhanced flexibility.

FIG. 22 shows an alternative embodiment in which the barrier 30 comprises high-flexibility sections 94. The sections 94 are approximately aligned with the ball of the foot, where the flip flops experience the greatest bending during walking. The sections 94 can bend and fold more easily than other areas of the barrier 30. The sections 94 can comprise the same material as the barrier 30, but with reduced thickness. Alternatively, the sections 94 can comprise a different material from the rest of the barrier 30. For example, the sections 94 can comprise fabric and the rest of the barrier 30 can comprise closed cell foam.

The present invention provides a desirable combination of exceptional breathability and excellent water protection. The present flip flop is highly breathable because the top is mostly open, and because it can move vertically relative to the foot. The breathability is superior to enclosed shoes made with breathable fabrics. The barrier provides exceptional water protection because it can be made of water-impermeable, non-breathable material such as closed cell foam. If the barrier is tall enough, it can provide better water protection than a water resistant shoe.

What is claimed is:

1. A flip flop sandal, comprising:

1) a sole;

2) a medial strap attached to the sole and to a connection point;

3) a lateral strap attached to the sole and to the connection point;

4) a toe strap attached to the sole and to the connection point;

5) a barrier attached to the sole along a perimeter of the sole, wherein the barrier extends upwardly from the sole, forms a continuous loop, and has a height everywhere of at least 40% of a toe strap length;

and wherein the medial strap, lateral strap, and toe strap are attached to the sole at attachment locations interior to the barrier.

2. The flip flop sandal of claim 1 wherein the barrier height everywhere is in the range of 0.5 to 4 times the toe strap length.

3. The flip flop sandal of claim 1 wherein the barrier has an average height in the range of 1-4 inches.

4. The flip flop sandal of claim 1 wherein the barrier has an average height in the range of 0.7-4 inches.

5. The flip flop sandal of claim 1 wherein the barrier and the sole comprise a single integral part.

6. The flip flop sandal of claim 1 wherein an average height of the barrier in a front portion is greater than an average height of the barrier in a rear portion.

7. The flip flop sandal of claim 1 wherein an outside surface of the medial strap or an outside surface of the lateral strap is attached to an interior surface of the barrier.

8. The flip flop sandal of claim 1 further comprising a cover, wherein the cover is removably attachable to one of the straps, or is removably attachable to the connection point.

9. A flip flop sandal, comprising:

1) a sole;

2) a medial strap attached to the sole and to a connection point;

3) a lateral strap attached to the sole and to the connection point;

4) a toe strap attached to the sole and to the connection point;

5) a barrier attached to the sole along a perimeter of the sole, wherein the barrier extends upwardly from the sole, forms a continuous loop, and has a height in the range of 0.5 to 4 inches everywhere;

and wherein the medial strap, lateral strap, and toe strap are attached to the sole at attachment locations interior to the barrier.

10. The flip flop sandal of claim 9 wherein the barrier height is in the range of 0.7 to 3 inches everywhere.

11. The flip flop sandal of claim 9 wherein the barrier has an average height in the range of 0.7-4 inches.

12. The flip flop sandal of claim 9 wherein the barrier has an height in the range of 1-4 inches everywhere.

13. The flip flop sandal of claim 9 wherein an average height of the barrier in a front portion is greater than an average height of the barrier in a rear portion.

14. The flip flop sandal of claim 9 wherein an outside surface of the medial strap or an outside surface of the lateral strap is attached to an interior surface of the barrier.

15. The flip flop sandal of claim 9 further comprising a cover, wherein the cover is removably attachable to at least one of the straps or is removably attachable to the connection point.

16. The flip flop sandal of claim 9 wherein the barrier and the sole comprise a single integral part.

17. A flip flop sandal, comprising:

1) a sole;

2) a medial strap attached to the sole and to a connection point;

3) a lateral strap attached to the sole and to the connection point;

4) a toe strap attached to the sole and to the connection point;

5) a barrier attached to the sole along the entire perimeter of the sole, wherein the barrier extends upwardly from the sole, forms a continuous loop, is waterproof, and has a height everywhere in the range of 0.5-4 inches;

and wherein the attachment between the barrier and the sole is waterproof;

and wherein the medial strap, lateral strap, and toe strap are attached to the sole at attachment locations interior to the barrier.

18. The flip flop sandal of claim 17 wherein an average height of the barrier is in the range of 0.7-4 inches.

19. The flip flop sandal of claim 17 wherein the barrier height is in the range of 0.7 to 3 inches everywhere.

20. The flip flop sandal of claim 17 further comprising a cover, wherein the cover is removably attachable to at least one of the straps or is removably attachable to the connection point.

* * * * *